US006662940B1

(12) United States Patent
Kowal

(10) Patent No.: US 6,662,940 B1
(45) Date of Patent: Dec. 16, 2003

(54) DRAINING SOAP DISH FOR MULTIPLE BARS OF SOAP

(76) Inventor: Casimer Kowal, 934 Grove St., Angola, NY (US) 14006

( * ) Notice: Subject to any disclaimer, the term of this patent is extended or adjusted under 35 U.S.C. 154(b) by 52 days.

(21) Appl. No.: 09/933,436

(22) Filed: Aug. 20, 2001

(51) Int. Cl.[7] ..... A47K 5/08; B65D 6/04
(52) U.S. Cl. ..... 206/77.1; 206/564; 4/628
(58) Field of Search ..... 206/77.1, 822, 206/564; 4/628; 220/574, 571, 608, 669; D6/536

(56) References Cited

U.S. PATENT DOCUMENTS

| | | | | | |
|---|---|---|---|---|---|
| 1,311,666 | A | * | 7/1919 | Perkins | 206/77.1 |
| 2,036,204 | A | * | 4/1936 | Enssle | 206/77.1 |
| D154,903 | S | * | 8/1949 | Caldwell | D6/536 |
| D184,219 | S | * | 1/1959 | Foster | D6/536 |
| 4,548,572 | A | | 10/1985 | Hoffman | 425/410 |
| 4,754,883 | A | * | 7/1988 | Grzywa | 206/564 |
| 5,129,615 | A | * | 7/1992 | Strauss | 206/564 |
| D345,067 | S | | 3/1994 | Shafer | D6/536 |
| 5,743,388 | A | | 4/1998 | Kerr et al. | 206/77.1 |
| 5,941,376 | A | * | 8/1999 | Liggett | 206/77.1 |
| 5,947,272 | A | * | 9/1999 | Park | 206/77.1 |

* cited by examiner

*Primary Examiner*—Mickey Yu
*Assistant Examiner*—John Pickett
(74) *Attorney, Agent, or Firm*—Goldstein & Lavas, P.C.

(57) ABSTRACT

A draining soap dish for multiple bars of soap including a top plate having a plurality of rectangular shaped opening's therethrough in a spaced relationship. The openings each are dimensioned for receiving a bar of soap therethrough. The top plate has four support walls extending downwardly therefrom. One of the support walls has a drainage recess extending upwardly of a free edge thereof. A plurality of containers are coupled with respect to the openings of the top plate for receiving a bar of soap therein. Each of the containers have an open upper end, a closed tapered lower end, opposed end walls, and opposed side walls. The open upper ends of the containers are positioned within the openings of the top plate. The plurality of containers each have U-shaped drainage slots therein extending along the opposed side walls and the closed tapered lower end.

4 Claims, 2 Drawing Sheets

Fig. 2
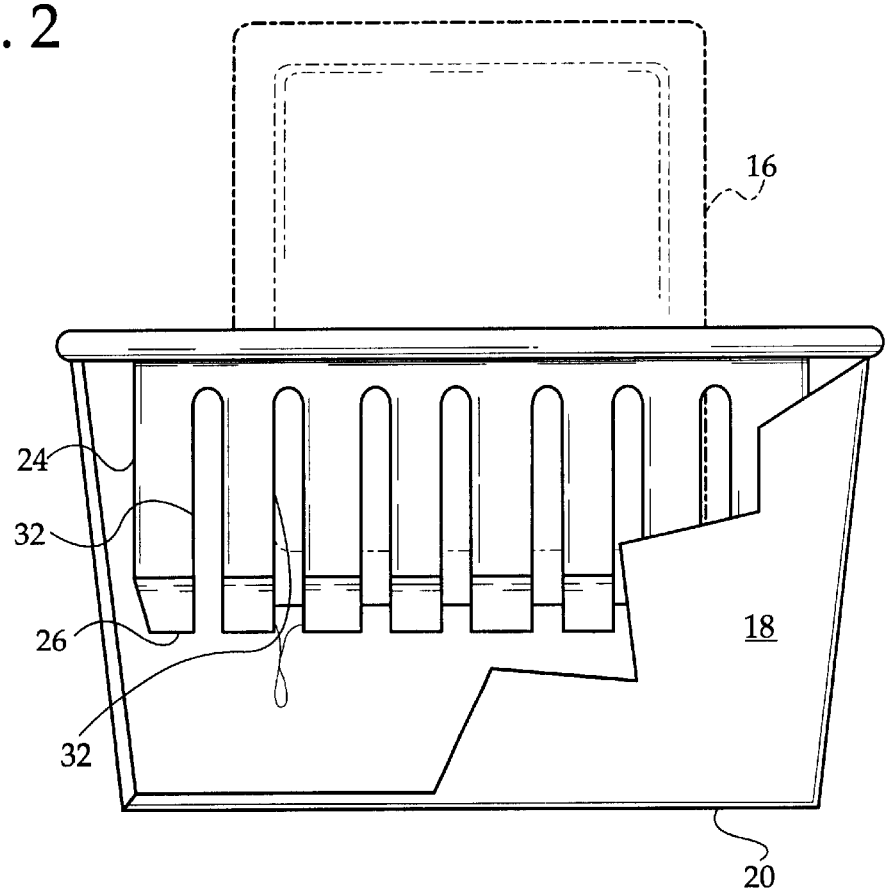
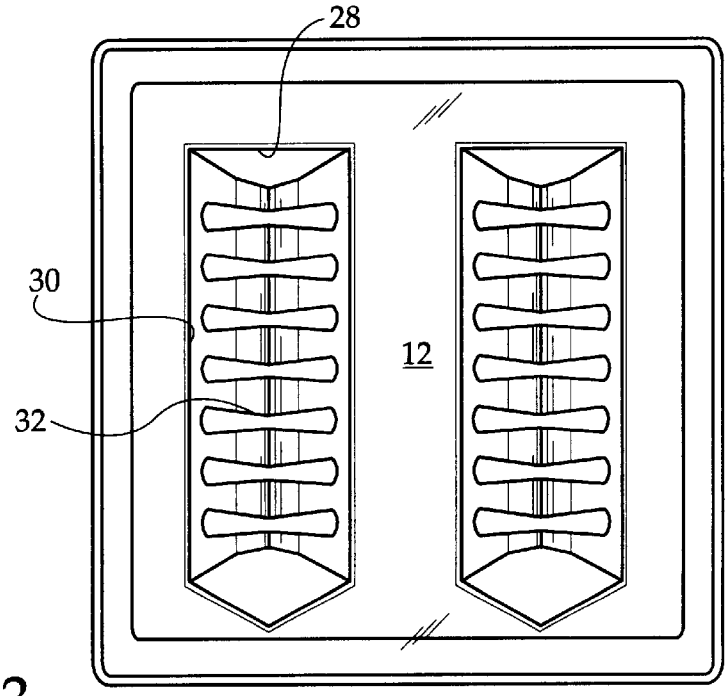
Fig. 3

DRAINING SOAP DISH FOR MULTIPLE BARS OF SOAP

BACKGROUND OF THE INVENTION

The present invention relates to a draining soap dish for multiple bars of soap and more particularly pertains to holding a plurality of bars of soap while preventing their softening.

The use of soap holding receptacles is known in the prior art. More specifically, soap holding receptacles heretofore devised and utilized for the purpose of containing soap are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,548,572 to Hoffman discloses a soap saving rack capable of holding two or more pieces of soap in a vertical orientation. U.S. Pat. No. 5,743,388 to Kerr discloses a package for holding multiple bars of soap. U.S. Pat. No. Des. 345,067 to Shafer discloses an ornamental design for a soap dish.

While these devices fulfill their respective, particular objective and requirements, the aforementioned patents do not describe a draining soap dish for multiple bars of soap for holding a plurality of bars of soap while preventing their softening.

In this respect, the draining soap dish for multiple bars of soap according to the present invention substantially departs from the conventional concepts and designs of the prior art, and in doing so provides an apparatus primarily developed for the purpose of holding a plurality of bars of soap while preventing their softening.

Therefore, it can be appreciated that there exists a continuing need for a new and improved draining soap dish for multiple bars of soap which can be used for holding a plurality of bars of soap while preventing their softening. In this regard, the present invention substantially fulfills this need.

SUMMARY OF THE INVENTION

In the view of the foregoing disadvantages inherent in the known types of soap holding receptacles now present in the prior art, the present invention provides an improved draining soap dish for multiple bars of soap. As such, the general purpose of the present invention, which will be described subsequently in greater detail, is to provide a new and improved draining soap dish for multiple bars of soap which has all the advantages of the prior art and none of the disadvantages.

To attain this, the present invention essentially comprises a top plate having a generally rectangular configuration. The top plate has a plurality of rectangular shaped opening's therethrough in a spaced relationship. The openings each are dimensioned for receiving a bar of soap therethrough. The top plate has four support walls extending downwardly therefrom. One of the support walls has a drainage recess extending upwardly of a free edge thereof. A bottom plate is disposed below the top plate. The bottom plate has a generally rectangular configuration. The bottom plate is secured to the four support walls of the top plate whereby a space is disposed between the top plate and the bottom plate. The bottom plate has a ridged upper surface. A plurality of containers are coupled with respect to the openings of the top plate for receiving a bar of soap therein. Each of the containers have an open upper end, a closed tapered lower end, opposed end walls, and opposed side walls. The open upper ends of the containers are positioned within the openings of the top plate. The plurality of containers each have U-shaped drainage slots therein extending along the opposed side walls and the closed tapered lower end.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved draining soap dish for multiple bars of soap which has all the advantages of the prior art soap holding receptacles and none of the disadvantages.

It is another object of the present invention to provide a new and improved draining soap dish for multiple bars of soap which may be easily and efficiently manufactured and marketed.

It is a further object of the present invention to provide a new and improved draining soap dish for multiple bars of soap which is of durable and reliable construction.

An even further object of the present invention is to provide a new and improved draining soap dish for multiple bars of soap which is susceptible of a low cost of manufacture with regard to both materials and labor, and which accordingly is then susceptible of low prices of sale to the consuming public, thereby making such a draining soap dish for multiple bars of soap economically available to the buying public.

Even still another object of the present invention is to provide a new and improved draining soap dish for multiple bars of soap for holding a plurality of bars of soap while preventing their softening.

Lastly, it is an object of the present invention to provide a new and improved draining soap dish for multiple bars of soap including a top plate having a plurality of rectangular shaped opening's therethrough in a spaced relationship. The openings each are dimensioned for receiving a bar of soap therethrough. The top plate has four support walls extending downwardly therefrom. One of the support walls has a drainage recess extending upwardly of a free edge thereof. A plurality of containers are coupled with respect to the openings of the top plate for receiving a bar of soap therein. Each of the containers have an open upper end, a closed tapered lower end, opposed end walls, and opposed side walls. The open upper ends of the containers are positioned within the openings of the top plate.

The plurality of containers each have U-shaped drainage slots therein extending along the opposed side walls and the closed tapered lower end.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a side elevation view of the present invention.

FIG. 3 is a top plan view of the present invention.

The same reference numerals refer to the same parts through the various figures.

DESCRIPTION OF THE PREFERRED EMBODIMENT

Figure 1:
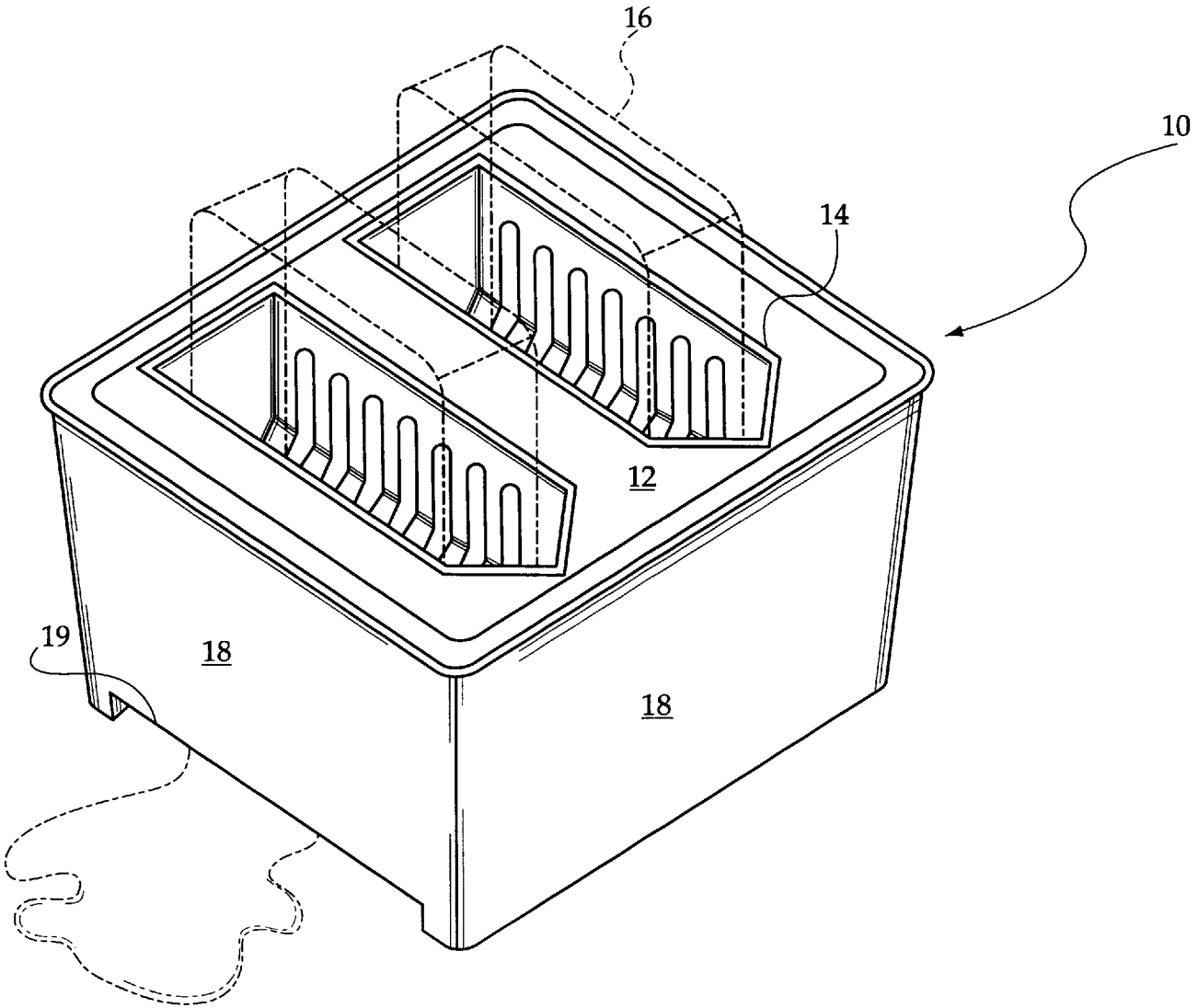
FIG. 1 is a perspective view of the preferred embodiment of the draining soap dish for multiple bars of soap constructed in accordance with the principles of the present invention.

With reference now to the drawings, and in particular, to FIGS. 1 through 3 thereof, the preferred embodiment of the new and improved draining soap dish for multiple bars of soap embodying the principles and concepts of the present invention and generally designated by the reference number 10 will be described.

Specifically, it will be noted in the various figures that the device relates to a draining soap dish for multiple bars of soap for holding a plurality of bars of soap while preventing their softening. In its broadest context, the device consists of a top plate, a bottom plate, and a plurality of containers. Such components are individually configured and correlated with respect to each other so as to attain the desired objective.

The top plate 12 has a generally rectangular configuration. The top plate 12 has a plurality of rectangular shaped openings 14 therethrough in a spaced relationship. The openings 14 each are dimensioned for receiving a bar of soap 16 therethrough. Note FIGS. 1 and 2. The top plate 12 has four support walls 18 extending downwardly therefrom. One of the support walls 18 has a drainage recess 19 extending upwardly of a free edge thereof.

"The bottom plate 20 is disposed below the top plate 12. The bottom plate 20 has a generally rectangular configuration. The bottom plate 20 is secured to the four support walls 18 of the top plate 12 whereby a space is disposed between the top plate 12 and the bottom plate 20. In the preferred embodiment, the device 10 is essentially free standing whereby the top plate 12 and the bottom plate 20 are in parallel relationship. Note FIG. 1. It should be noted that in an alternate embodiment, where the device 10 is secured to a wall area or the like, the bottom plate 20 can be angularly disposed with respect to the top plate 12 to provide a drainage gradient.

The plurality of containers 24 are coupled with respect to the openings 14 of the top plate 12 for receiving a bar of soap 16 therein. Each of the containers 24 have an open upper end, a closed tapered lower end 26, opposed end walls 28, and opposed side walls 30. The open upper ends of the containers 24 are positioned within the openings 14 of the top plate 12. The plurality of containers 24 each have U-shaped drainage slots 32 therein each extending vertically along the opposed side walls 30 and connecting across the closed tapered lower end 26. The drainage slots 32 will allow water to drain off of the bar of soap 16 therethrough so that the bar of soap 16 will not sit in collected water and soften. The water will then exit the present invention through a space created between the recess 19 and the bottom plate 20."

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A draining soap dish for multiple bars of soap for holding a plurality of bars of soap while preventing their softening comprising, in combination:

a top plate having a generally rectangular configuration, the top plate having a plurality of rectangular shaped opening's therethrough in a spaced relationship, the openings each being dimensioned for receiving a bar of soap therethrough, the top plate having four support walls extending downwardly therefrom, one of the support walls having a drainage recess extending upwardly of a free edge thereof;

a bottom plate disposed below the top plate, the bottom plate having a generally rectangular configuration, the bottom plate being secured to the four support walls of the top plate whereby a space is disposed between the top plate and the bottom plate; and a plurality of containers coupled with respect to the openings of the top plate for receiving a bar of soap therein, each of the containers having an open upper end, a closed tapered lower end, opposed end walls, and opposed side walls, the open upper ends of the containers being positioned within the openings of the top plate, the plurality of containers each having U-shaped drainage slots therein, each of said U-shaped drainage slots extending vertically along the opposed side walls and connecting across the closed tapered lower end.

2. A draining soap dish for multiple bars of soap for holding a plurality of bars of soap while preventing their softening comprising, in combination:

a top plate having a plurality of rectangular shaped opening's therethrough in a spaced relationship, the openings each being dimensioned for receiving a bar of soap therethrough, the top plate having four support walls extending downwardly therefrom, one of the support walls having a drainage recess extending upwardly of a free edge thereof; and a plurality of containers coupled with respect to the openings of the top plate for receiving a bar of soap therein, each of the containers having an open upper end, a closed tapered lower end, opposed end walls, and opposed side walls, the open upper ends of the containers being positioned within the openings of the top plate, the plurality of containers each having U-shaped drainage slots therein, each of said U-shaped drainage slots extending vertically along the opposed side walls and connecting across the closed tapered lower end.

3. The draining soap dish for multiple bars of soap as set forth in claim 2, and further including a bottom plate disposed below the top plate.

4. The draining soap dish for multiple bars of soap as set forth in claim 3, wherein the bottom plate is secured to the four support walls of the top plate whereby a space is disposed between the top plate and the bottom plate.

* * * * *